US009957072B2

(12) United States Patent
Shurtleff et al.

(10) Patent No.: US 9,957,072 B2
(45) Date of Patent: May 1, 2018

(54) PROCESS SECTION OF A PACKAGING MACHINE

(71) Applicant: STANDARD KNAPP INC., Portland, CT (US)

(72) Inventors: David J. Shurtleff, Cromwell, CT (US); Patrick Lee Nelson, East Hampton, CT (US); David A. Kardok, Southington, CT (US)

(73) Assignee: STANDARD KNAPP INC., Portland, CT (US)

( * ) Notice: Subject to any disclaimer, the term of this patent is extended or adjusted under 35 U.S.C. 154(b) by 726 days.

(21) Appl. No.: 14/525,106

(22) Filed: Oct. 27, 2014

(65) Prior Publication Data

US 2016/0114921 A1 Apr. 28, 2016

(51) Int. Cl.

| | |
|---|---|
| ***B65B 43/42*** | (2006.01) |
| ***B65B 43/10*** | (2006.01) |
| ***B65B 21/04*** | (2006.01) |
| ***B65B 59/00*** | (2006.01) |

(52) U.S. Cl.

CPC ..... *B65B 43/10* (2013.01); *B65B 21/04* (2013.01); *B65B 59/00* (2013.01)

(58) Field of Classification Search

CPC ..... B65B 43/10; B65B 43/08; B65B 43/48; B65B 43/52; G65G 37/005

USPC ..... 53/543, 284.5, 375.4, 376.3; 198/570

See application file for complete search history.

(56) References Cited

U.S. PATENT DOCUMENTS

| | | | | |
|---|---|---|---|---|
| 3,760,557 | A * | 9/1973 | McIntyre | B65B 61/207 198/419.3 |
| 4,364,465 | A | 12/1982 | Kraft et al. | |
| 4,460,349 | A * | 7/1984 | Charron | B31B 1/00 493/131 |
| 4,638,729 | A | 1/1987 | Woodworth et al. | |
| 4,642,967 | A * | 2/1987 | Culpepper | B65B 5/026 198/419.1 |
| 4,736,569 | A | 4/1988 | Hudson et al. | |
| 4,871,068 | A | 10/1989 | Dreyfus | |
| 4,878,337 | A * | 11/1989 | Raudat | B65B 61/207 53/207 |
| 4,887,414 | A | 12/1989 | Arena | |
| 5,531,661 | A * | 7/1996 | Moncrief | B65B 43/265 493/313 |
| 5,588,276 | A * | 12/1996 | Terjung | B65B 5/04 53/169 |
| 5,971,906 | A | 10/1999 | Tharpe, Jr. et al. | |

(Continued)

FOREIGN PATENT DOCUMENTS

KR 2020120004609 5/2013

OTHER PUBLICATIONS

International Search Report and Written Opinion dated Jan. 11, 2016 in related PCT Application No. PCT/US2015/057331.

(Continued)

*Primary Examiner* — Gloria R Weeks
(74) *Attorney, Agent, or Firm* — Cantor Colburn LLP

(57) ABSTRACT

A processing section of a packaging machine includes a conveyor configured to be driven by a first drive member, and at least one additional conveyor including at least one tray folding member configured to selectively extend about and ride on the conveyor. The at least one additional conveyor is configured to be driven by a second drive member that is distinct from the first drive member.

22 Claims, 12 Drawing Sheets

(56) References Cited

U.S. PATENT DOCUMENTS

| | | | | |
|---|---|---|---|---|
| 5,997,459 | A | 12/1999 | Krüger et al. | |
| 7,401,453 | B2 * | 7/2008 | Ford | B65B 21/242 53/251 |
| 7,470,226 | B1 | 12/2008 | Herrin | |
| 8,448,777 | B2 | 5/2013 | Pazdernik | |
| 2006/0042188 | A1 * | 3/2006 | Ford | B65B 21/06 53/398 |
| 2014/0290178 | A1 | 10/2014 | Koster et al. | |
| 2016/0114921 | A1 | 4/2016 | Shurtleff et al. | |

OTHER PUBLICATIONS

International Search Report and Written Opinion dated Jan. 28, 2016 in related PCT Application No. PCT/US2015/057334.

* cited by examiner

PROCESS SECTION OF A PACKAGING MACHINE

BACKGROUND OF THE INVENTION

Exemplary embodiments pertain to the art of packaging systems and, more particularly, to a process section of a packaging machine.

In-line continuous motion packaging machines are set up to process a particular package format. For example, a particular machine may be set up to process unsupported articles, articles supported on a pad, or articles supported on a tray. The machine may be adaptable for different package sizes, but typically not for different package types. More specifically, a packaging machine may include various changeover points that are adaptable for different package sizes. Different packaging sizes may accommodate different types, sizes, numbers and shapes of articles to be packaged in a particular packaging format.

Multi-format packaging machines are growing in popularity. A typical multi-format packaging machine will include a tray forming section. When in a tray package format, the tray forming section constructs a tray about a number of articles that may be subsequently wrapped with plastic. When in a pad package format or in an unsupported package format, the tray forming section is not needed. When not in use, the tray forming section may be lowered or removed from the packaging machine and replaced with a flight section. Lowering and/or removing the tray forming section is a labor intensive effort that requires many man hours and the use of material handling devices such as forklifts, jacks, and/or cranes, and the like. Further, once removed, there is a need to store the tray forming section which reduces available storage and work space about the machine.

BRIEF DESCRIPTION OF THE INVENTION

Disclosed is a processing section of a packaging machine including a conveyor configured to be driven by a first drive member, and at least one additional conveyor including at least one tray folding member configured to selectively extend about and ride on the conveyor. The at least one additional conveyor is configured to be driven by a second drive member that is distinct from the first drive member.

Also disclosed is a system including a conveyor configured to be driven by a first drive member, and an additional conveyor configured to selectively extend about and ride on the conveyor, the at least one additional conveyor configured to be driven by a second drive member that is distinct from the first drive member.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
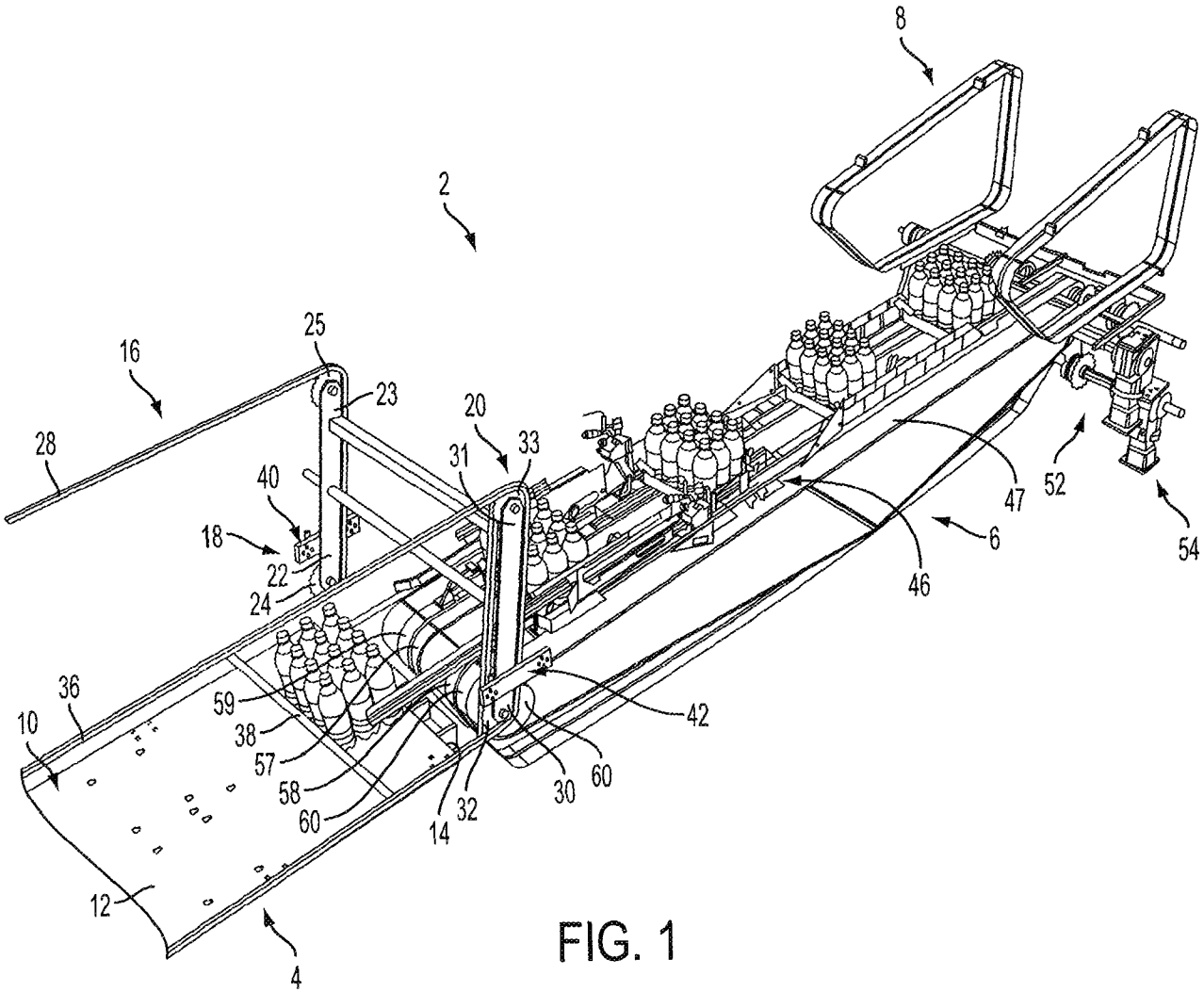
FIG. 1 depicts a partial perspective view of a processing section of a packaging machine in a tray supported article configuration, in accordance with an aspect of an exemplary embodiment.
Figure 2:
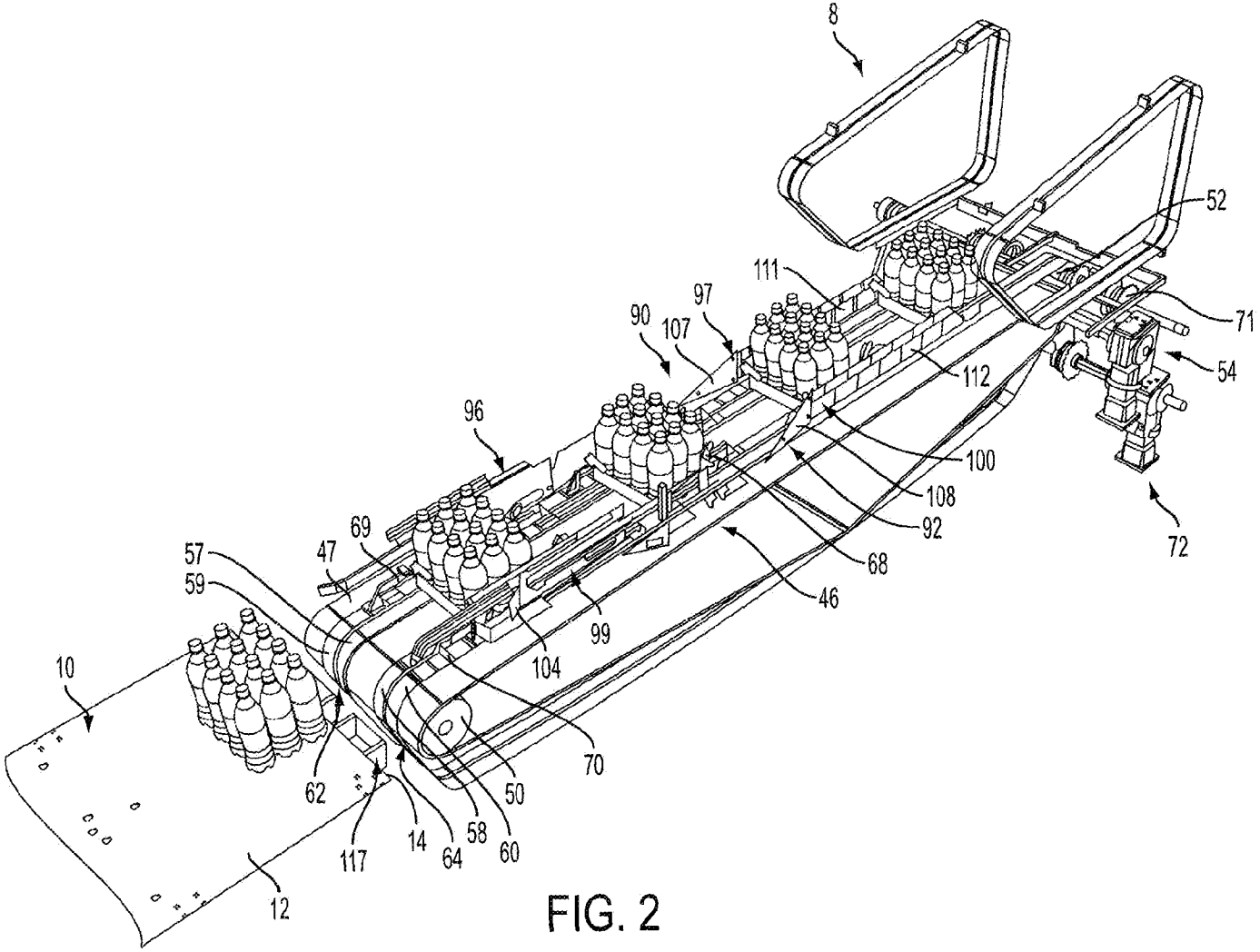
FIG. 2 depicts the processing section of FIG. 1 with a portion of a lead-in system removed.
Figure 3:
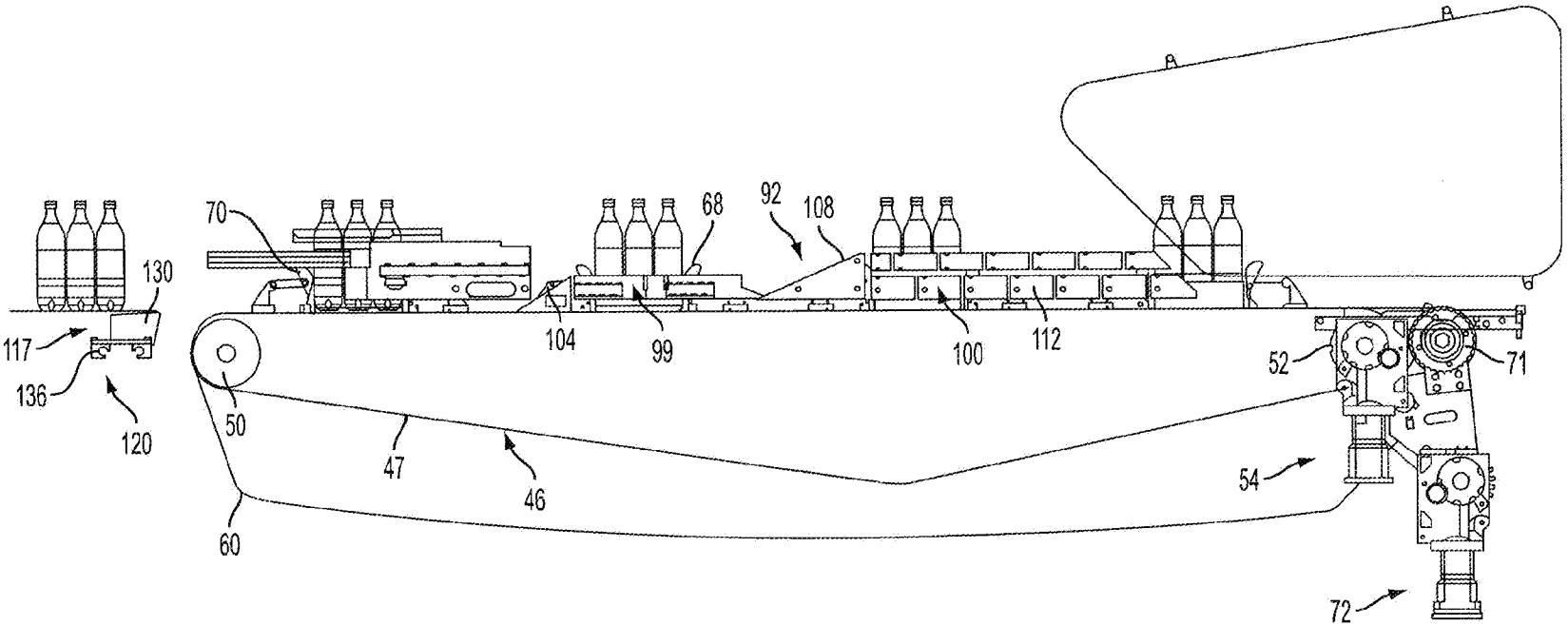
FIG. 3 depicts a side view of the processing section of FIG. 2.
Figure 4:
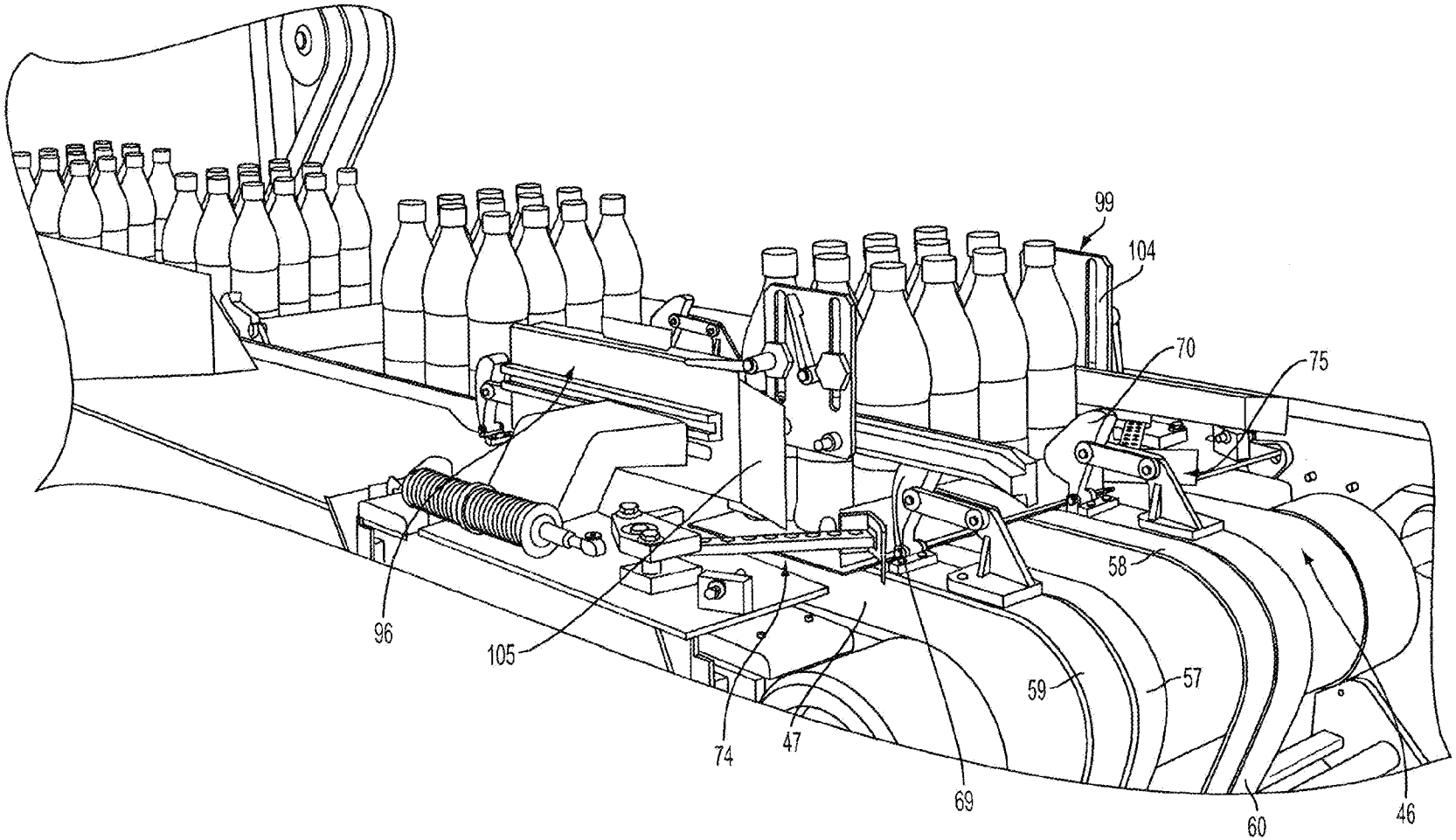
FIG. 4 depicts a partial perspective view of a trailing edge flap of a product support tray blank being acted upon by a first pair of tray folding members, in accordance with an aspect of an exemplary embodiment.
Figure 5:
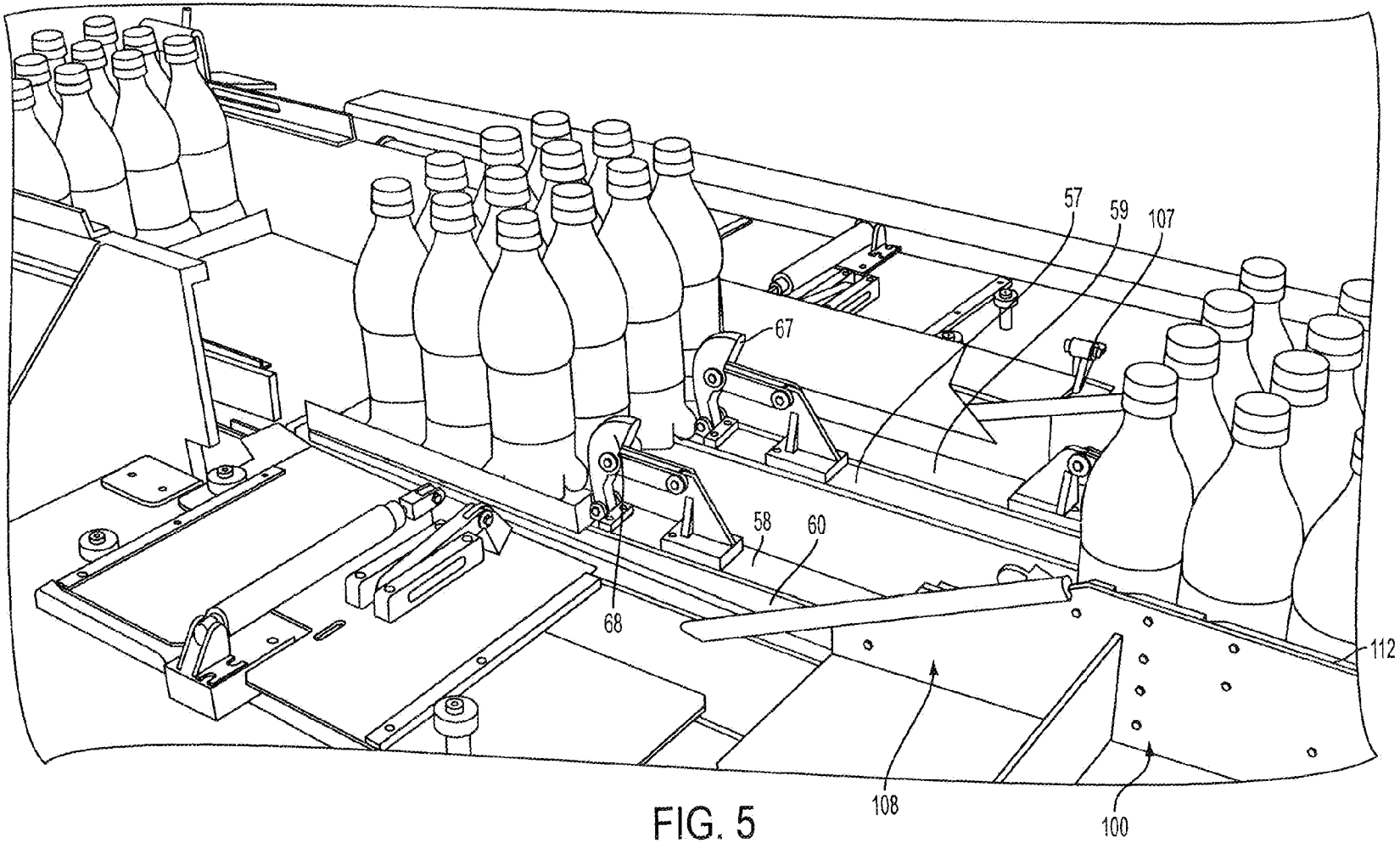
FIG. 5 depicts a partial perspective view of a leading edge flap of the product support tray blank being acted upon by a second pair of tray folding members, in accordance with an aspect of an exemplary embodiment.
Figure 6:
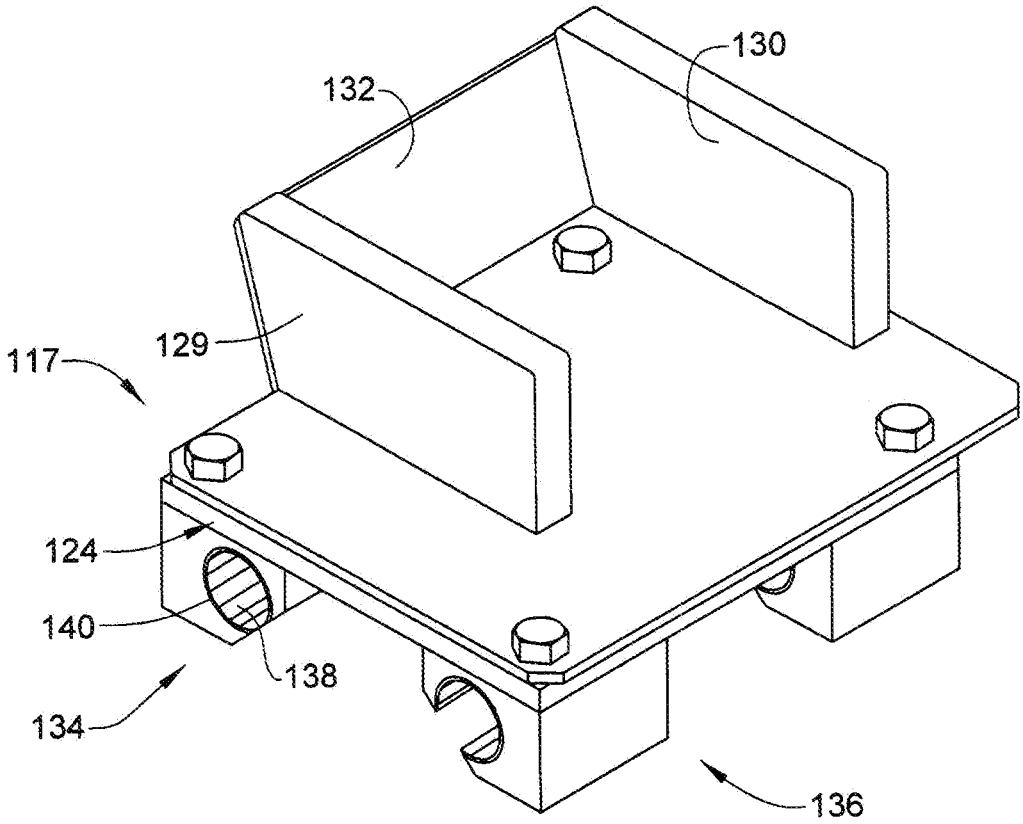
FIG. 6 depicts a perspective view of a transfer plate of the processing system of FIG. 1.

A processing section of a packaging machine is indicated generally at 2 in FIG. 1. Processing section 2 includes a lead-in system 4, a processing portion 6, and a lead-off system 8. Lead-off system 8 guides articles to a downstream process (not shown). Processing section 2 is mounted to a support frame (not shown). Lead-in system 4 includes a support member 10 having a substantially planar surface 12 and a downstream end 14. Lead-in system 4 also includes a product transport system 16 that guides products or articles to be packaged along support member 10 toward processing portion 6.

Product transport system 16 includes a first arm member 18 arranged on a first side of support member 10 and a second arm member 20 arranged on a second side of support member 10. First arm member 18 extends from a first end 22 to a second end 23. First end 22 includes a first pulley 24 and second end 23 includes a second pulley 25. First and second pulleys 24 and 25 may include a plurality of gear teeth (not separately labeled). First arm member 18 supports a first drive 28. Second arm member 20 extends from a first end 30 to a second end 31. First end 30 includes a first pulley 32 and second end 31 includes a second pulley 33. First and second pulleys 32 and 33 may include gear teeth (not separately labeled). Second arm member 20 supports a second drive 36. A bar 38 extends between first and second drives 28 and 36. Bar 38 moves along support member 10 to motivate products toward processing portion 6. It should be understood that the first and second drives may take the form of belts, chains, and the like that may carry and/or motivate bar 38 along support member 10.

First arm member 18 is coupled to a first adjustment assembly 40 and second arm member 20 is coupled to a second adjustment assembly 42. First and second adjustment assemblies 40 and 42 allow first and second arm members 18 and 20 to pivot about corresponding ones of first ends 22, 30.

In this manner, bar 38 may be phased forward and/or rearward. For example, when in a tray processing configuration, as shown in FIGS. 1-4, first and second arm members 18 and 20 may be phased forward.

Figure 7:
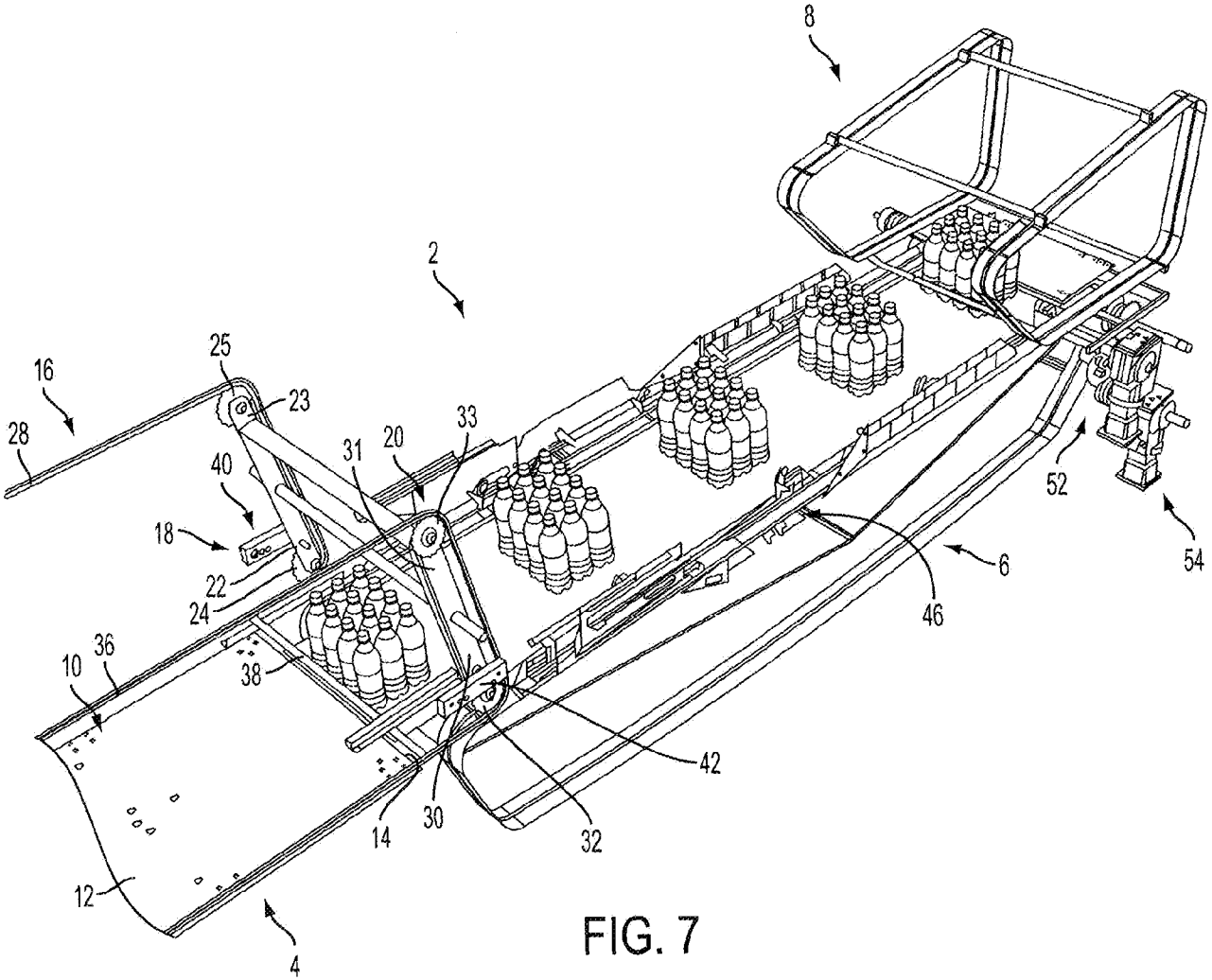
FIG. 7 depicts a partial perspective view of the processing section of FIG. 1 in an unsupported article configuration, in accordance with another aspect of an exemplary embodiment.
Figure 11:
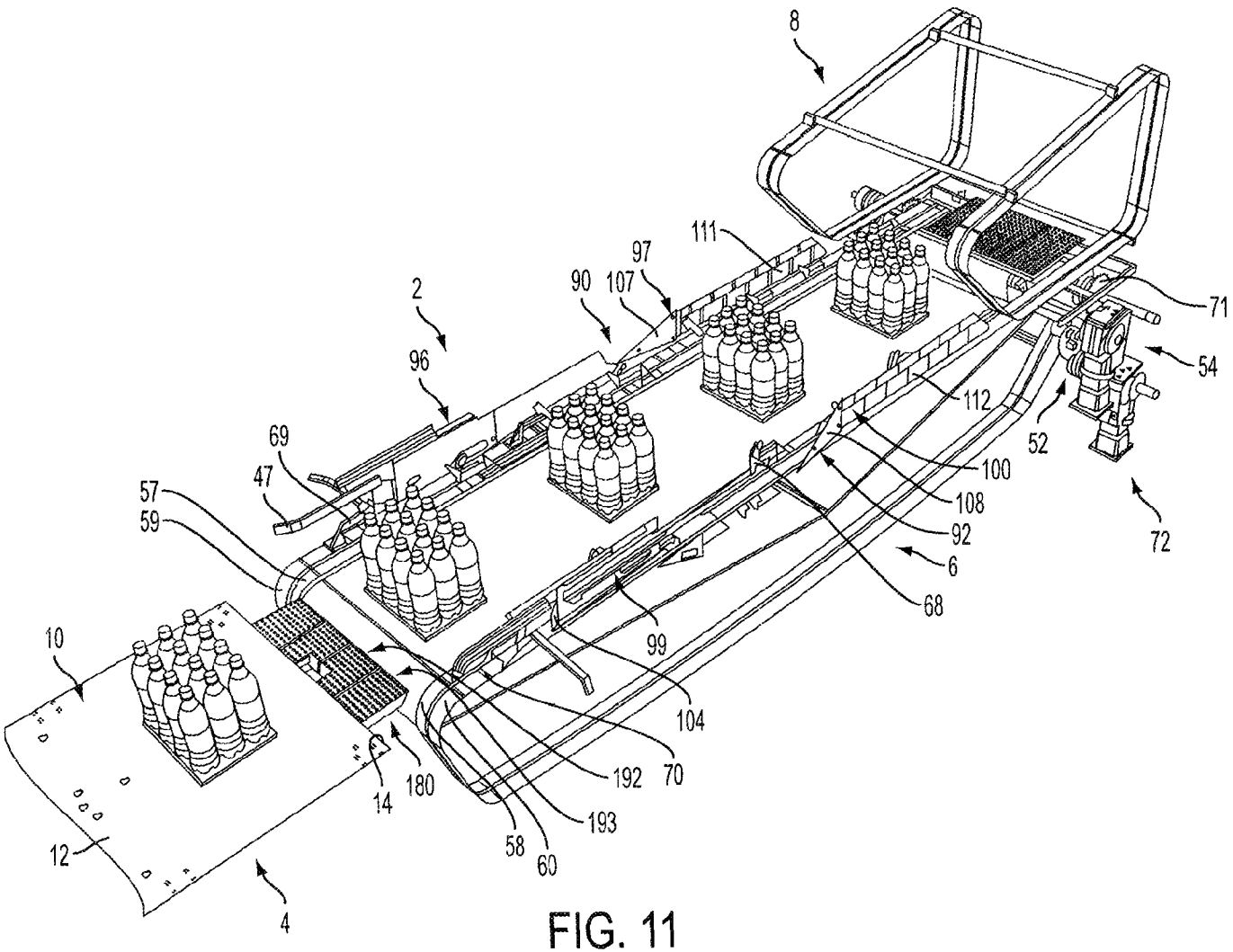
FIG. 11 depicts a partial perspective view of the processing section of FIG. 1 in a pad supported article configuration with the portion of the lead-in system removed, in accordance with another aspect of an exemplary embodiment.

In an unsupported article processing configuration, such as shown in FIG. 7, first and second arm members 18 and 20 may be phased rearward. Phasing arm members 18 and 20 rearward shifts a position of pulleys 24 and 32 and first and second drives 28 and 36 toward processing section 6. Phasing arm members 18 and 20 rearward to shift bar 38 forward provides additional motivational support or increases a contact time between bar 38 and the unsupported articles to maintain a desired spacing between the articles and facilitate a tightly packed package. First and second arm members 18 and 20 may also be arranged in the second position when processing section 2 is in a pad supported article processing configuration, such as shown in FIG. 11.

As shown in FIGS. 2-5, processing portion 6 includes a conveyor 46 having an outer surface 47. The term "conveyor", as used in accordance with the exemplary embodiments, should be understood to include belts, chains, or other systems continuous or otherwise that transport an article from one position to another. Conveyor 46 is supported by a first roller member 50 and a second roller member 52. Second roller member 52 is operably connected to a first drive member 54. Processing portion 6 also includes a first additional conveyor 57, a second additional conveyor 58, a third additional conveyor 59 and a fourth additional conveyor 60. At this point, while shown with four additional conveyors, it should be understood that processing section 6 may include only a single additional conveyor.

As will be detailed more fully below, additional conveyors 57-60 selectively extend about and ride on outer surface 47 of conveyor 46. More specifically, in the tray processing configuration first and third additional conveyors 57 and 59 define a first pair of additional conveyors 62 arranged on a first lateral side (not separately labeled) of conveyor 46, and second and fourth additional conveyors 58 and 60 define a second pair of additional conveyors 64 arranged on a second, opposing lateral side (not separately labeled) of conveyor 46. When in the unsupported or pad supported processing configuration, first and second pairs of additional conveyors 62 and 64 are shifted laterally outwardly of conveyor 46.

First additional conveyor 57 includes a first plurality of tray folding members 67 and second additional conveyor 59 includes a second plurality of tray folding members 68. Tray folding members 67 and 68 are arranged in aligned pairs that move along conveyor 46. Tray folding members 67 and 68 are pivotable and operated to fold a leading edge flap (not separately labeled) of a support tray blank (also not separately labeled) upward. More specifically, as articles supported on the tray blank are transferred to processing system 6 from lead-in system 4, tray folding members 67 and 68 interact with and fold the leading edge flap upward. It should also be understood that the additional conveyor could include other structure or could be devoid of any additional structure.

Third additional conveyor 59 includes a third plurality of tray folding members 69 and fourth additional conveyor 60 includes a fourth plurality of tray folding members 70. Tray folding members 69 and 70 are arranged in aligned pairs that move along conveyor 46. Tray folding members 69 and 70 are pivotable and operated to fold a trailing edge flap (not separately labeled) of the support tray blank upward. More specifically, as articles supported on the tray blank are transferred from lead-in system 4 to processing system 6, tray folding members 69 and 70 interact with and fold the trailing edge flap upward. Tray folding members 69 and 70 also assist in providing a motivational force to move the articles supported on the support tray blank onto conveyor 46.

Each of additional conveyors 57-60 are connected to a corresponding geared pulley such as shown at 71. Geared pulleys 71 are driven by a second drive member 72. Geared pulleys 71 interact with gear teeth (not separately labeled) provided on an underside (also not separately labeled) of each additional conveyor 57-60. In this manner, additional conveyors 57-60 maintain a desired relative alignment but also a desired timing relative to conveyor 46. In accordance with an aspect of an exemplary embodiment, first drive member 52 drives conveyor 46 at a first speed and second drive member 72 drives additional conveyors at a second speed. In accordance with another aspect of the exemplary embodiment, the first speed is distinct from the second speed. In accordance with another aspect of the exemplary embodiment, the first speed is less than the second speed.

Processing portion 6 also includes a first selectively deployable folding element 74 and a second selectively deployable folding element 75. First and second selectively deployable folding elements 74 and 75 are pivoted to fold corresponding first and second flap portions (not separately labeled) of the trailing edge flap of the support tray blank toward the leading edge flap. Processing portion 6 may also include a first selectively deployable compression assembly 90 and a second selectively deployable compression assembly 92. First and second selectively deployable compression assemblies 90 and 92 are arranged on lateral sides of conveyor 46 and, as will be detailed more fully below, operated to interact with the support tray blank to form a support tray (not separately labeled). First selectively deployable compression assembly 90 includes a first portion 96 and a second portion 97. Second portion 97 is arranged downstream of first portion 96. Similarly, second selectively deployable compression assembly 92 includes a first portion 99 and a second portion 100. Second portion 100 is arranged downstream of first portion 99.

First portion 96 of first selectively deployable compression assembly 90 includes a first angled lead-in section 104. Similarly, first portion 99 of second selectively deployable compression assembly 92 includes a first angled lead-in section 105. First angled lead-in sections 104 and 105 operate to fold corresponding first and second flap portions (not separately labeled) of the leading edge flap of the support tray blank toward the trailing edge flap. Second portion 97 of first selectively deployable compression assembly 90 includes a second angled lead-in section 107 and second portion 100 of second selectively deployable compression assembly 92 includes a second angled lead-in section 108. Second angled lead-in sections 107 and 108 operate to fold opposing side portions (not separately labeled) of the support tray blank toward one another and onto the first and second flap portions of corresponding ones of the leading edge flap and the trailing edge flap to establish a support tray form (also not separately labeled).

At this point, the support tray form is passed through a first plurality of compression members 111 provided on second portion 97 of first selectively deployable compression assembly 90, and a second plurality of compression members 112 is provided on second portion 100 of second selectively deployable compression assembly 92. Compression members 111 and 112 are positioned to urge the opposing side portions of the support tray blank onto the first and second flap portions of corresponding ones of the leading edge flap and the trailing edge flap to initiate a bonding process that forms the support tray. First and second selectively deployable compression assemblies 90 and 92 may be positioned relative to one another to accommodate a wide range of tray sizes. Further, additional compression members (not shown) may be arranged downstream of first and second selectively deployable compression assemblies 90 and 92 if a longer bonding time is desired.

Processing section 2 may also include a transfer plate 117 that bridges a gap (not separately labeled) between lead-in system 4 and processing portion 6. Transfer plate 117 is slidingly supported on one or more mounting rails 120 that extend substantially perpendicularly to a direction of movement of conveyor 46. It should be understood that additional transfer plates (not separately labeled) may also exist between processing section 6 and lead-off system 8. The additional transfer plates may be dropped into place across a gap (also not separately labeled) between processing section 6 and lead-off section 8 or slide into place on mounting rails (not shown). It should also be understood that the particular shape and arrangement of the mounting rails may vary. Mounting rails 120 allow for a rapid reconfiguration of processing section 2 between tray supported article processing, unsupported article processing, and pad supported article processing. In the tray processing configuration, transfer plate 117 includes a body 124 including a first tray slide 129 and a second tray slide 130. First and second tray slides 129 and 130 facilitate a transfer from lead-in system 4 and processing portion 6. Body 124 also supports first and second pairs of mounting elements 134 and 136. Each mounting element 134 and 136 includes a hook section 138 that may include a plurality of grooves 140. Grooves 140 reduce contact area between pairs of mounting elements 134 and 136 and mounting rails 120 to ease installation and removal of transfer plate 117. Of course, it should be understood that the number and form of the mounting elements may vary.

Figure 8:
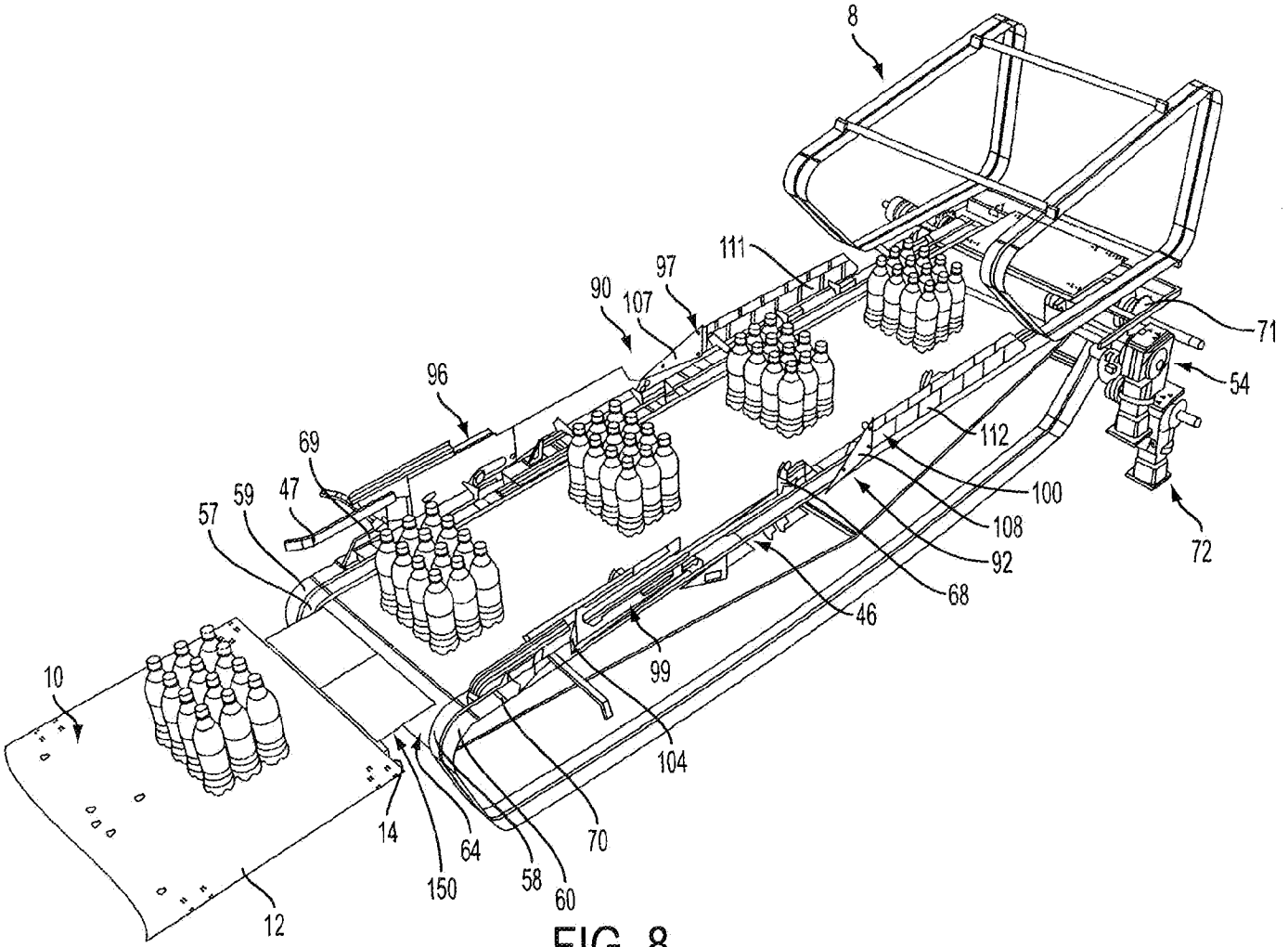
FIG. 8 depicts the processing section of FIG. 7 with the portion of the lead-in system removed.
Figure 9:
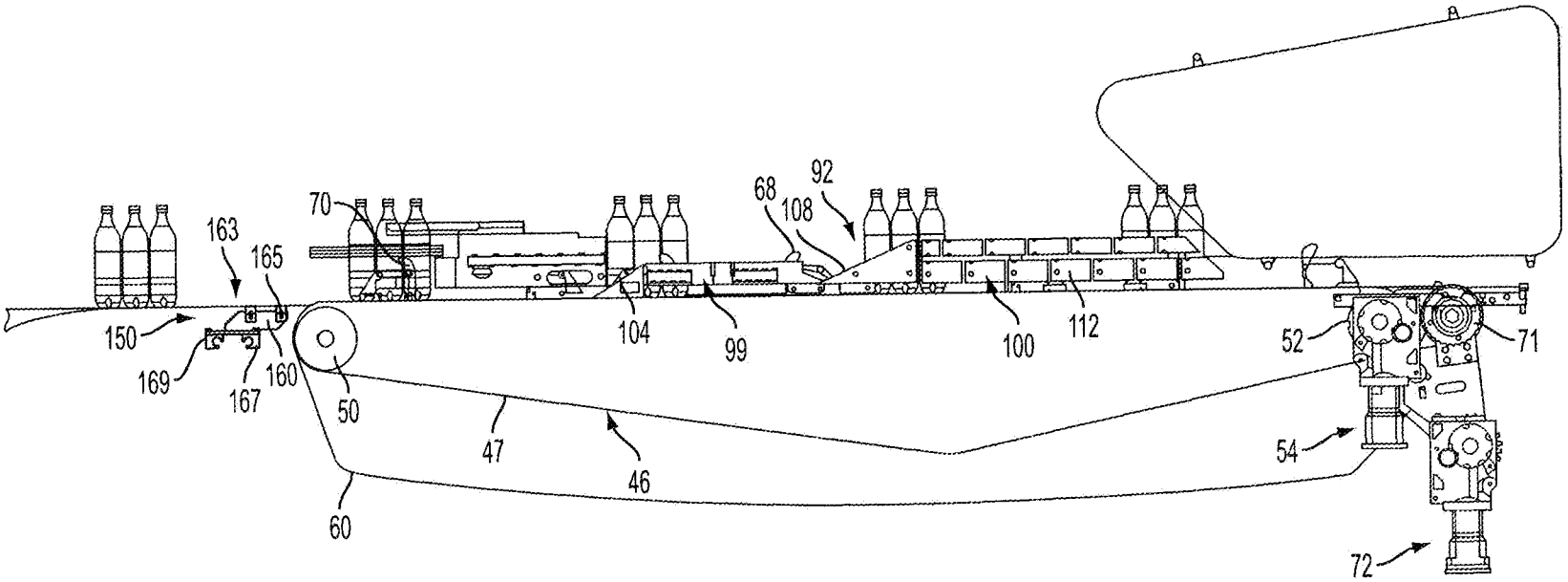
FIG. 9 depicts a side view of the processing section of FIG. 8.

As noted above, processing section 2 is readily reconfigurable between the tray supported article processing configuration (FIGS. 1-3), the unsupported article processing configuration (FIGS. 7-9) and the pad supported article processing configuration (FIG. 11). Reconfiguration may take thirty minutes or less and require little if any support equipment. For example, when reconfiguring from the tray supported article processing configuration to the unsupported article processing configuration, additional conveyors 57-60 are moved laterally outwardly of conveyor 46. Geared pulley(s) 72 are shiftable along an axel (not separately labeled) and first pair of additional conveyors 62 may be shifted to a first lateral side of conveyor 46 and second pair of additional conveyors 64 may be shifted to a second, opposing lateral side of conveyor 46, as shown in FIGS. 7 and 8.

Figure 10:
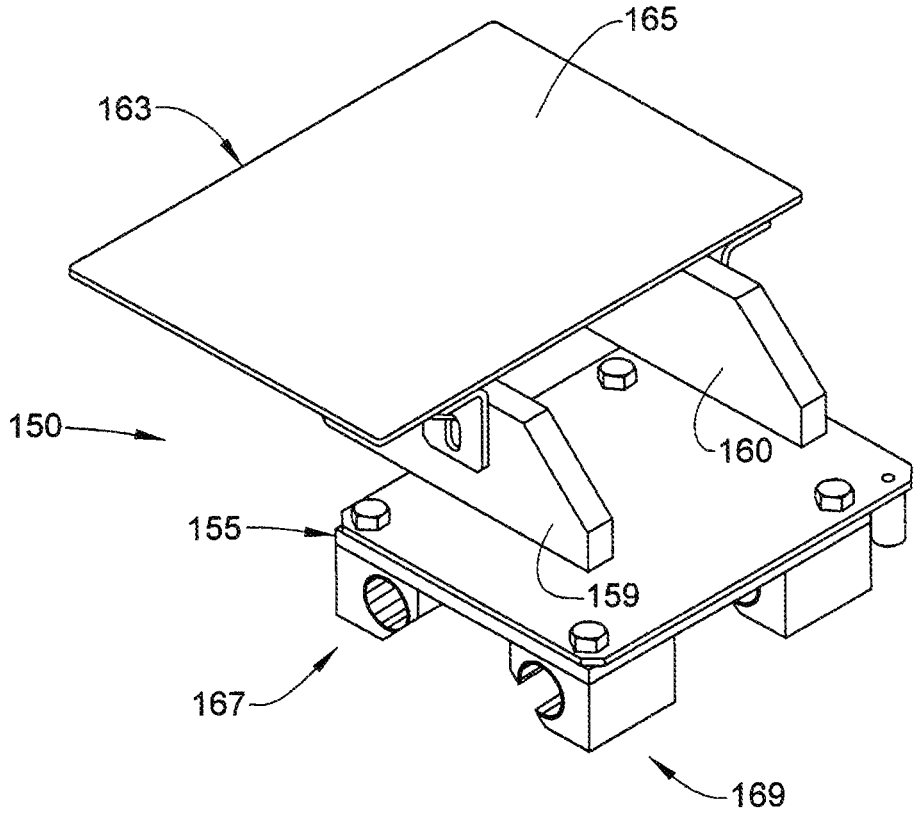
FIG. 10 depicts a perspective view of a transfer plate of the processing system of FIG. 7.

In addition to the outward shifting of additional conveyors 57-60, first compression assembly 90 is shifted to the first lateral side of conveyor 46 and second compression assembly 92 is shifted to the second lateral side of conveyor 46. In this manner, an unobstructed process flow path is established between lead-in system 4 and lead-off system 8. In addition, transfer plate 117 is replaced by a transfer plate 150 that is configured to lead unsupported articles from lead-in system 4 onto conveyor 46, as shown in FIG. 10. Transfer plate 150 is slidingly supported on mounting rails 120. It should be understood that additional transfer plates (not separately labeled) may also exist between processing section 6 and lead-off system 8. The additional transfer plates may be dropped into place across a gap (also not separately labeled) between processing section 6 and lead-off section 8 or slide into place on mounting rails (not shown). Transfer plate 150 includes a body 155 that supports first and second mounting rail elements 159 and 160 that support a plate 163. Plate 163 includes a substantially planar surface 165. Transfer plate 150 also includes first and second pairs of mounting elements 167 and 169 that are similar to mounting elements 134 and 136. Of course, it should be understood that the number and form of the mounting elements may vary.

Figure 12:
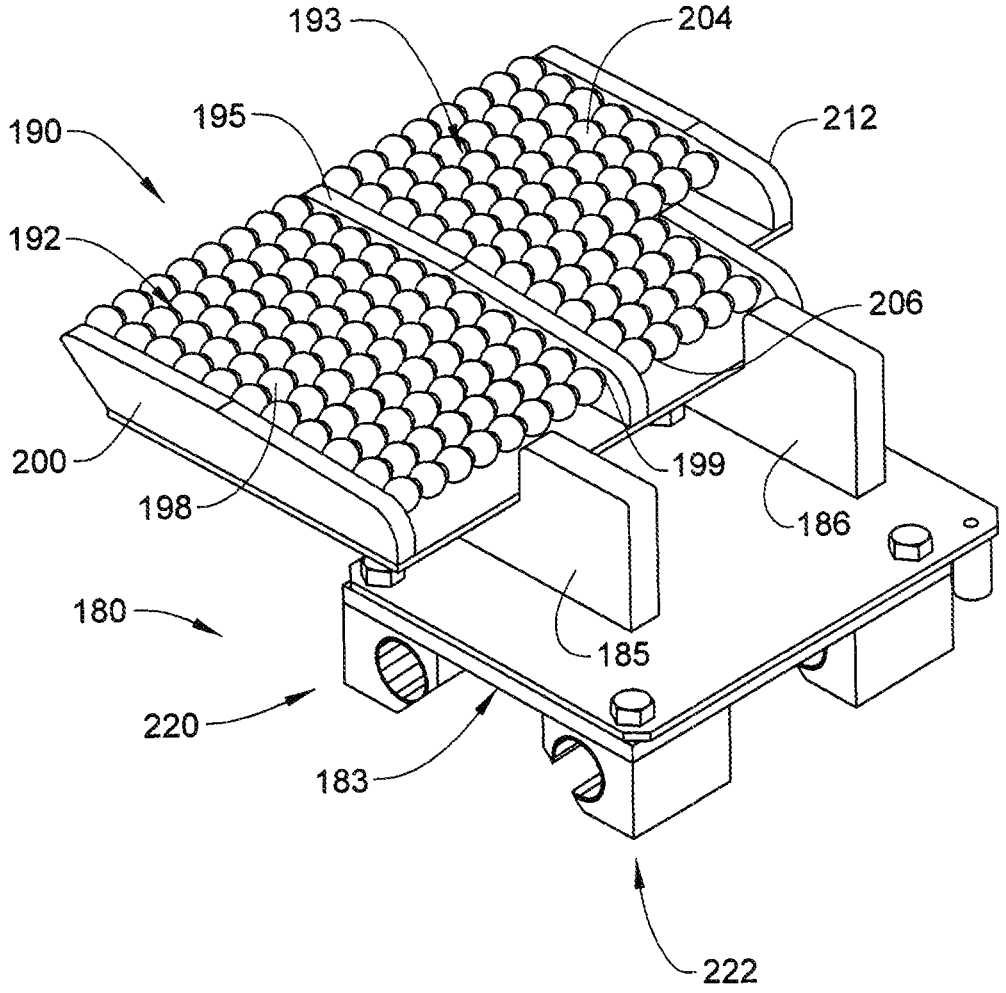
FIG. 12 depicts a perspective view of a transfer plate of the processing system of FIG. 11.

When reconfiguring from the unsupported article processing configuration (FIGS. 7-9) to the pad supported article processing configuration (FIG. 11), transfer plate 150 is readily replaced with a transfer plate 180 as shown in FIG. 12. Transfer plate 180 is slidingly supported on mounting rails 120. It should be understood that additional transfer plates (not separately labeled) may also exist between processing section 6 and lead-off system 8. The additional transfer plates may be dropped into place across a gap (also not separately labeled) between processing section 6 and lead-off section 8 or slide into place on mounting rails (not shown). Transfer plate 180 includes a body 183 that supports first and second mounting rail elements 185 and 186. Mounting rail elements 185 and 186 support a roller assembly 190. Roller assembly 190 includes a first roller section 192 and a second roller section 193 separated by a dividing wall 195. A plurality of rollers 198 are supported upon an axel 199 between an outer wall 200 and dividing wall 195 in first roller section 192. Similarly, a second plurality of rollers 204 is supported on axels 206 that extend between a second outer wall 212 and dividing wall 195 in second roller section 193. Roller assembly 190 facilitates the transfer of pad supported articles from lead-in system 4 onto conveyor 46. At this point it should be understood that processing section 6 may be reconfigured from tray supported article processing configuration and pad supported processing configuration. Transfer plate 180 also includes first and second pairs of mounting elements 167 and 169 that are similar to mounting elements 220 and 222. Of course, it should be understood that the number and form of the mounting elements may vary.

At this point it should be understood that the exemplary embodiments provide a readily reconfigurable processing section for a packaging machine. More specifically, the processing section may be reconfigured, in thirty minutes or less between a tray supported article processing configuration, an unsupported article processing configuration and/or a pad supported article processing configuration. Moreover, reconfiguration may be done by one or more people without the need for support equipment such as cranes, jacks, forklifts, and the like.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A processing section of a packaging machine comprising:

a conveyor configured to be driven by a first drive member; and at least one additional conveyor including at least one tray folding member configured to selectively extend about and ride on the conveyor, the at least one additional conveyor configured to be driven by a second drive member that is distinct from the first drive member.

2. The processing section according to claim 1, wherein the at least one additional conveyor includes a first additional conveyor including a first plurality of tray folding members configured to interact with a leading edge flap of a support tray blank, and a second additional conveyor including a second plurality of tray folding members configured to interact with a trailing edge flap of the support tray blank.

3. The processing section according to claim 2, further comprising: a third additional conveyor including a third plurality of tray folding members configured to interact with the leading edge flap of a support tray blank, and a fourth additional conveyor including a fourth plurality of tray folding members configured to interact with the trailing edge flap of the support tray blank.

4. The processing section according to claim 2, further comprising: a first selectively deployable compression assembly arranged at a first lateral side of the conveyor and a second selectively deployable compression assembly arranged at a second lateral side of the conveyor, the first and second selectively deployable compression assemblies being configured to apply a compressive force to opposing side flaps of the support tray blank.

5. The processing section according to claim 4, wherein each of the first and second compression assemblies includes a plurality of compression members.

6. The processing section according to claim 4, wherein each of the first and second compression assemblies includes a first portion having a first angled lead-in section and second portion having a second angled lead-in section, each the first angled lead-in sections being configured and disposed to interact with corresponding first and second opposing side portions of the leading edge flap and each of the second angled lead-in sections being configured to interact with opposing side flaps of the tray.

7. The processing section according to claim 2, further comprising: a first selectively deployable folding element arranged on a first lateral side of the conveyor and a second selectively deployable folding element arranged in a second lateral side of the conveyor, the first and second selectively deployable folding elements being configured and disposed to interact with corresponding first and second opposing flap portions of the trailing edge flap.

8. The processing section according to claim 2, further comprising: a lead-in system arranged at a upstream end of the conveyor, the lead-in system including a support member, a first arm member supporting a first drive and a second arm member supporting a second drive, and at least one bar extending between the first and second drives, the at least one bar being configured and disposed to motivate a plurality of articles to be packaged from the support member onto one of the conveyor and the at least one additional conveyor.

9. The processing section according to claim 8, wherein the first arm member is supported by a first adjustment assembly and the second arm member is supported by a second adjustment assembly, each of the first and second arm members being selectively pivotable to adjust a position of the at least one bar relative to a downstream end of the support member.

10. The processing section according to claim 8, further comprising:

at least one mounting rail arranged between the support member and the upstream end of the conveyor; and at least one transfer plate detachably mounted to the at least one mounting rail, the at least one transfer plate including a surface configured to guide the plurality of articles onto the one of the conveyor and the at least one additional conveyor.

11. The processing section according to claim 10, wherein the at least one transfer plate includes a first mounting element having a first hook section configured to slidingly receive a first one of the at least one mounting rail and a second mounting element having a second hook section configured to slidingly receive a second one of the at least one mounting rail.

12. The processing section according to claim 10, wherein the surface includes at least one tray slide configured and disposed to guide the support tray from the support member to the at least one additional conveyor.

13. The processing section according to claim 10, wherein the surface comprises a substantially planar surface configured and disposed to guide an unsupported plurality of articles from the support member to the conveyor.

14. The processing section according to claim 10, wherein the surface includes a plurality of rollers configured and disposed to guide a pad supported plurality of articles from the support member to the conveyor.

15. The processing section according to claim 1, wherein the first drive member drives the conveyor at a first speed and the second drive member drives the at least one additional conveyor at a second speed that is distinct from the first speed.

16. The processing section according to claim 15, wherein the second speed is greater than the first speed.

17. The processing section according to claim 1, wherein the first drive member is operatively connected to a first axel supporting at least one roller member configured and disposed to motivate the conveyor.

18. The processing section according to claim 17, wherein the second drive member is operatively connected to another axel supporting at least one pulley configured and disposed to motivate the at least one additional conveyor, the at least one pulley being selectively shiftable along the another axel.

19. The processing section according to claim 18, wherein the at least one additional conveyor includes a plurality of gear teeth configured and disposed to engage with the at least one pulley to establish a desired timing of the at least one tray folding member relative to the conveyor.

20. A system comprising:

a conveyor configured to be driven by a first drive member; and an additional conveyor configured to selectively extend about and ride on the conveyor, the additional conveyor configured to be driven by a second drive member that is distinct from the first drive member.

21. The processing section of a packaging machine according to claim 20, wherein the first drive member drives the conveyor at a first speed and the second drive member drives the additional conveyor at a second speed that is distinct from the first speed.

22. The processing section of a packaging machine according to claim 21, wherein the first speed is less than the second speed.

* * * * *